US011410838B2

(12) United States Patent
Senko et al.

(10) Patent No.: US 11,410,838 B2
(45) Date of Patent: Aug. 9, 2022

(54) LONG LIFE ELECTRON MULTIPLIER

(71) Applicant: Thermo Finnigan LLC, San Jose, CA (US)

(72) Inventors: Michael W. Senko, Sunnyvale, CA (US); Joshua T. Maze, Round Rock, TX (US); Scott T. Quarmby, Round Rock, TX (US)

( * ) Notice: Subject to any disclaimer, the term of this patent is extended or adjusted under 35 U.S.C. 154(b) by 0 days.

(21) Appl. No.: 17/011,359

(22) Filed: Sep. 3, 2020

(65) Prior Publication Data

US 2022/0068621 A1 Mar. 3, 2022

(51) Int. Cl.
*H01J 43/22* (2006.01)
*H01J 49/02* (2006.01)

(52) U.S. Cl.
CPC ..... *H01J 43/22* (2013.01); *H01J 49/025* (2013.01)

(58) Field of Classification Search
CPC ..... H01J 43/22; H01J 49/025
See application file for complete search history.

(56) References Cited

U.S. PATENT DOCUMENTS

| | | | |
|---|---|---|---|
| 3,440,466 | A | 4/1969 | Colvin et al. |
| 3,541,331 | A | 11/1970 | Hunt et al. |
| 3,749,967 | A | 7/1973 | Douglas-Hamilton et al. |
| 4,061,944 | A | 12/1977 | Gay |
| 4,468,282 | A | 8/1984 | Neukermans |
| RE33,344 | E | 9/1990 | Stafford |
| 5,134,337 | A | 7/1992 | Kongslie et al. |
| 5,391,958 | A | 2/1995 | Kelly |
| 5,463,218 | A | 10/1995 | Holle |
| 6,002,202 | A | 12/1999 | Meyer et al. |
| 7,573,031 | B2 | 8/2009 | Behar et al. |
| 7,728,292 | B2 | 6/2010 | Jolliffe et al. |
| 9,437,406 | B2 | 9/2016 | Ishizu et al. |
| 2004/0046120 | A1 | 3/2004 | Moses et al. |
| 2016/0217972 | A1 | 7/2016 | Hayashi |

FOREIGN PATENT DOCUMENTS

| | | | |
|---|---|---|---|
| WO | 2019/178649 | A1 | 9/2019 |
| WO | 2020/069557 | A1 | 4/2020 |
| WO | 2020243795 | A1 | 12/2020 |

OTHER PUBLICATIONS

Van der Graaf, et al., "The Tynode: A new vacuum electron multiplier", Nuclear Instruments and Methods in Physics Research A 847 (2017), pp. 148-161.

(Continued)

*Primary Examiner* — Joseph L Williams
(74) *Attorney, Agent, or Firm* — David A. Schell

(57) ABSTRACT

An electron multiplier includes a series of discrete electron emissive surfaces or a continuous electron emissive resistive surface configured to provide an electron amplification chain; and a housing surrounding the series of electron emissive surfaces or the continuous electron emissive resistive surface and separating the environment inside the housing from the environment outside the housing. The housing includes an electron-transparent, gas-impermeable barrier configured to allow electrons to pass through into the housing to reach a first discrete electron emissive surface of the series of discrete electron emissive surfaces or a first portion of the continuous electron emissive resistive surface.

20 Claims, 6 Drawing Sheets

(56) References Cited

OTHER PUBLICATIONS

Barnett, "The Characteristics of an Electron Multiplier as a Detector of Heavy Particles", Oak Ridge National Laboratory, ORNL 1669 Instrumentation, 1954, 84 pages.

Sugiura, "The Secondary-emission Electron Multiplier Tube Used on a Mass Spectrometer and its Amplification of Ion Currents", Bulletin of the Chemical Society of Japan, 1962, vol. 35 (8), pp. 1257-1262.

Thermo Fisher Scientific, "ICP-MS Systems and Technologies", Dec. 2017, 9 pages, URL: https://www.thermofisher.com/us/en/home/industrial/spectroscopy-elemental-isotope-analysis/spectroscopy-elemental-isotope-analysis-learning-center/trace-elemental-analysis-tea-information/inductively-coupled-plasma-mass-spectrometry-icp-ms-information/icp-ms-systems-technologies.html.

"Transparency and Translucency—Wikipedia", XP055602508, Retrieved from the Internet: URL: https://en.wikipedia.org/wiki/Transparency_and_translucency[retrieved on Jul. 4, 2019], 11 pages.

Dyab et al., "Particle stabilised emulsions studied by WETSEM technique", Soft Matter, 2010, 6, pp. 2613-2615.

LONG LIFE ELECTRON MULTIPLIER

FIELD

The present disclosure generally relates to the field of mass spectrometry including long life electron multipliers.

INTRODUCTION

Mass spectrometers ionize analytes to form charged particles or ions which are separated according to mass-to-charge ratios. The ions can impact an ion detector surface to generate secondary particles, such as secondary electrons. Electron multipliers are often used to amplify the secondary electrons to produce a detectable signal which is proportional to the number of ions impacting the ion detector. A mass spectrum shows the relative abundance of detected ions as a function of mass-to-charge ratio.

Electron multipliers generally operate by way of secondary electron emission. Particles impact the surface which causes the surface to release multiple electrons. One type of electron multiplier is known as a discrete-dynode electron multiplier with a series of discrete surfaces (dynodes). Each dynode in the series is set to an increasingly more positive voltage. Alternatively, a continuous-dynode electron multiplier has a continuous semiconductor surface such that the surface has an increasingly more positive voltage from the entrance to the exit. Electrons released at one potential move to and impact a surface of a more positive potential causing the release of more electrons. As the electrons move from the entrance to the exit, the number of electrons can be dramatically increased, resulting in a stronger signal.

Electron multipliers "age" with time. This is thought to be due to the "stitching" of organic compounds to the dynodes by electrons. The organic material at the surface then reduces the yield of the dynode. This results in a reduction in gain, which necessitates a recalibration of the applied cathode potential to restore the desired gain. This frequent recalibration is inconvenient for the user, and ultimately results in the replacement of the multiplier when the required potential exceeds the capabilities of the associated power supply or the breakdown potential of the multiplier itself.

From the foregoing it will be appreciated that a need exists for improved electron multipliers, particularly with longer lifetimes.

SUMMARY

In a first aspect, an electron multiplier can include a series of discrete electron emissive surfaces or a continuous electron emissive resistive surface configured to provide an electron amplification chain and a housing surrounding the series of electron emissive surfaces or the continuous electron emissive resistive surface and separating the environment inside the housing from the environment outside the housing. The housing can include an electron-transparent, gas-impermeable barrier configured to allow electrons to pass through into the housing to reach a first discrete electron emissive surface of the series of discrete electron emissive surfaces or a first portion of the continuous electron emissive resistive surface.

In various embodiments of the first aspect, the electron-transparent, gas-impermeable barrier can include a ceramic sheet.

In particular embodiments, the ceramic can include silicon nitride (SiN), silicon dioxide ($SiO_2$), silicon carbide (SiC), silicon monoxide (SiO), titanium nitride (TiN), beryllium nitride ($Be_3N_2$), boron carbide ($B_4C$), aluminum carbide ($Al_4C_3$), or any combination thereof.

In various embodiments of the first aspect, the electron-transparent, gas-impermeable barrier can include a metal foil, a polymer film, or any combination thereof. In particular embodiments, metal foil can include aluminum (Al), gold (Au), nickel (Ni), beryllium (Be), titanium (Ti), magnesium (Mg), stainless steel, or any combination thereof. In particular embodiments, the polymer film can include polyimide, polyamide, polyamide-imide, polyethylene, polyethylene terephthalate, polyester, polypyrrole, cellulose, polyvinal acetate, polyvinal formal, polyvinal butral, parylene, or any combination thereof. In particular embodiments, the polymer film can be a metalized film. In particular embodiments, the electron-transparent, gas-impermeable barrier can include a high transmission grid positioned adjacent to the metal foil or polymer film.

In various embodiments of the first aspect, the housing can be hermetically sealed to maintain a vacuum inside the housing separate from the environment outside the housing. In particular embodiments, the housing can further include a getter material.

In various embodiments of the first aspect, the housing can further include a low gas conductance vent to partially equalize the pressure between inside and outside. In particular embodiments, the low gas conductance vent can include a tube. In particular embodiments, the tube can contain an absorbent material to prevent organic contaminates from entering the housing. In particular embodiments, the absorbent material can include a molecular sieve, activated carbon, or any combination thereof.

In various embodiments of the first aspect, the electron-transparent, gas-impermeable barrier can be configured to be at a potential more negative than the first discrete electron emissive surface of the series of discrete electron emissive surfaces or an entrance end of the continuous electron emissive semiconductor surface.

In various embodiments of the first aspect, the electron-transparent, gas-impermeable barrier can be held at ground.

In various embodiments of the first aspect, a mass spectrometer can include an ion source configured to produce ions from a sample; a mass analyzer configured to separate the ions based on mass-to-charge ratio; and a detector. The detector can include a conversion dynode; and an electron multiplier of the first aspect. In particular embodiments, the detector can further include a second conversion dynode, wherein the ions can have a negative charge, the conversion dynode can be configured to generate low molecular weight positive ions and/or protons when struck with the ions, and the second conversion dynode can be configured to generate electrons when struck with the low molecular weight positive ions and/or protons. In particular embodiments, the ions can have a positive charge and the conversion dynode can be configured to generate electrons when struck with the ions.

In a second aspect, a method of analyzing a sample includes ionizing the sample with an ion source to produce ions; separating the ions based on mass-to-charge ratio in a mass analyzer; directing the ions to a conversion dynode to produce electrons; passing the electrons through an electron-transparent, gas-impermeable barrier of a housing of an electron multiplier to strike a first discrete electron emissive surface of a series of discrete electron emissive surfaces or a continuous electron emissive semiconductor surface; amplifying the electrons with the series of discrete electron emissive surfaces or the continuous electron emissive semiconductor surface; and producing a signal at an anode proportional to the amplified electrons reaching the anode, the signal being proportional to an amount of a compound in the sample.

DRAWINGS

For a more complete understanding of the principles disclosed herein, and the advantages thereof, reference is now made to the following descriptions taken in conjunction with the accompanying drawings, in which.

Figure 1:
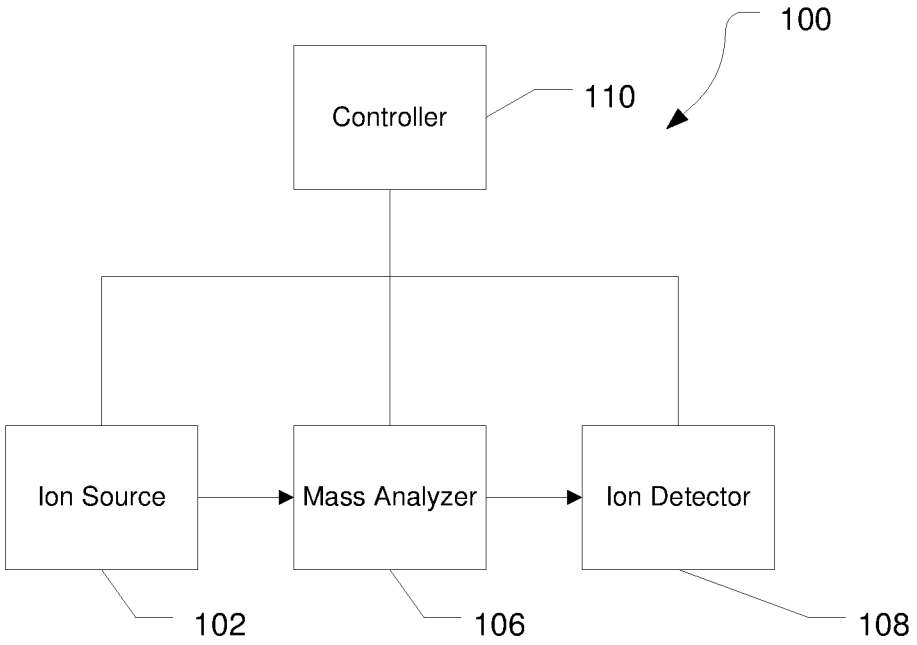
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of long-life electron multipliers are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 106, an ion detector 108, and a controller 110.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, desorption electron ionization (DESI) source, sonic spray ionization source, nanospray source, paper spray source, electron ionization source, chemical ionization source, photoionization source, glow discharge ionization source, thermospray ionization source, and the like.

In various embodiments, the mass analyzer 106 can separate ions based on a mass-to-charge ratio of the ions. For example, the mass analyzer 106 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 106 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio. In various embodiments, the mass analyzer 106 can be a hybrid system incorporating one or more mass analyzers and mass separators coupled by various combinations of ion optics and storage devices. For example, a hybrid system can a linear ion trap (LIT), a high energy collision dissociation device (HCD), an ion transport system, and a TOF.

In various embodiments, the ion detector 108 can detect ions. For example, the ion detector 108 can include an electron multiplier. Ions leaving the mass analyzer can be detected by the ion detector. In various embodiments, the ion detector can be quantitative, such that an accurate count of the ions can be determined. In various embodiments, such as with an electrostatic trap mass analyzer, the mass analyzer detects the ions, combining the properties of both the mass analyzer 106 and the ion detector 108 into one device.

In various embodiments, the controller 110 can communicate with the ion source 102, the mass analyzer 106, and the ion detector 108. For example, the controller 110 can configure the ion source 102 or enable/disable the ion source 102. Additionally, the controller 110 can configure the mass analyzer 106 to select a particular mass range to detect. Further, the controller 110 can adjust the sensitivity of the ion detector 108, such as by adjusting the gain. Additionally, the controller 110 can adjust the polarity of the ion detector 108 based on the polarity of the ions being detected. For example, the ion detector 108 can be configured to detect positive ions or be configured to detected negative ions.

Electron Multiplier

Figure 2A:
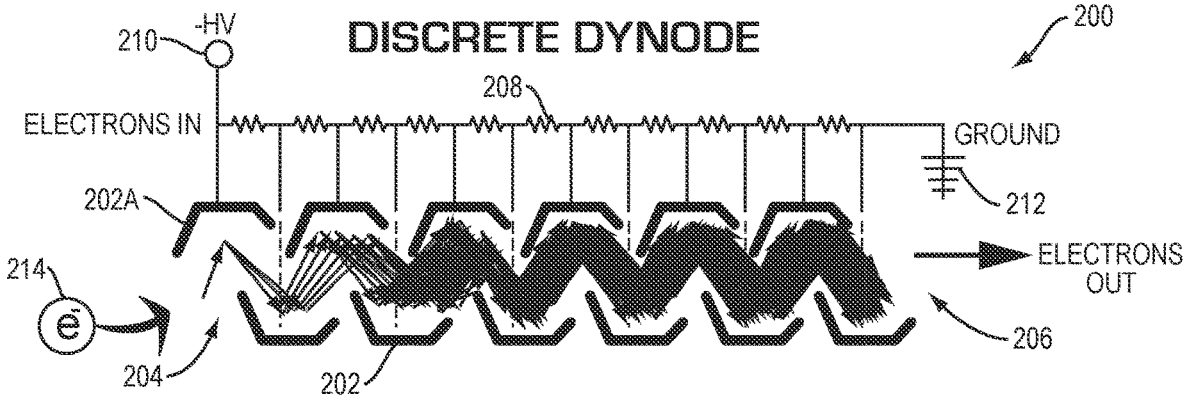
FIGS. 2A and 2B illustrate the operation of a discrete dynode electron multiplier and a continuous dynode electron multiplier respectively.

FIG. 2A is a discrete-dynode electron multiplier 200. Discrete-dynode electron multiplier 200 includes a series of dynodes 202 with electron emissive surfaces. The voltage applied to the dynodes 202 can be increasingly more positive moving from the entrance 204 to the exit 206. The individual voltages can be produced by a series of resistive elements 208 connecting contact 210 near the entrance 204 to contact 212 near the exit. In various embodiments, a large negative voltage can be applied to contact 210 and contact 212 can be grounded. In other embodiments, contact 210 can be grounded and contact 212 can be connected to a large positive voltage. In still other embodiments, neither contact 210 nor 212 can be connected to ground, with both contacts contacted to a voltage such that the voltage applied to contact 210 is more negative than the voltage applied to contact 212. This can include both voltages being negative, the voltage applied to contact 210 being negative and the voltage applied to contact 212 being positive, or both voltages being positive.

In various embodiments, secondary electron emission can begin when an electron 214 hits a first dynode 202A which ejects electrons that cascade onto more dynodes and repeats the process over again. The secondary electrons emitted from each dynode in the cascade can be accelerated towards the next electrode based on the potential difference between the two electrodes. The dynodes can be arranged such that the potential difference between any two adjacent dynodes are the same or vary to maximize secondary electron yield.

Figure 2B:
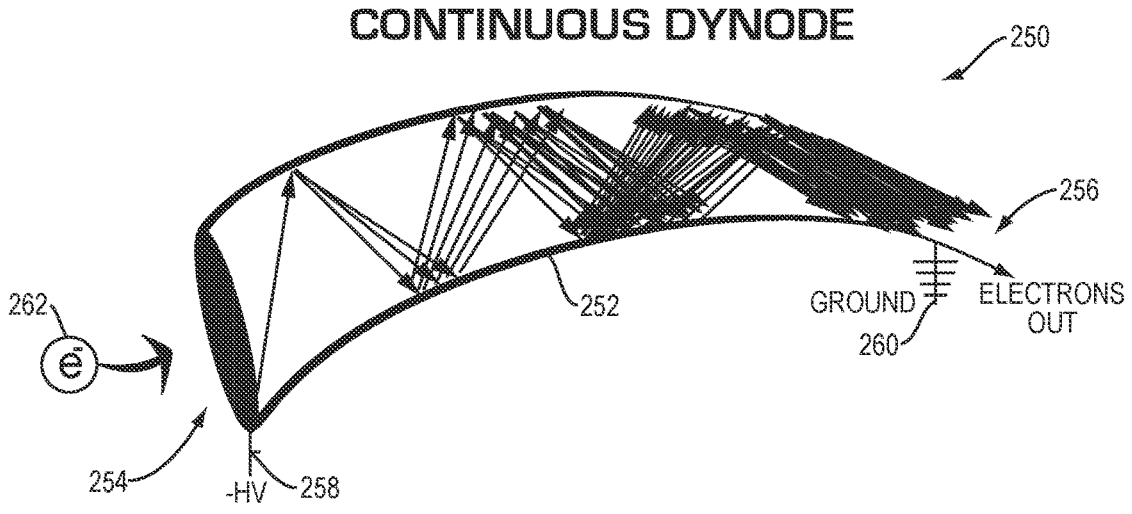

FIG. 2B is a continuous-dynode electron multiplier 250. Continuous-dynode electron multiplier 250 includes a horn shaped funnel electrode 252 coated with a thin film of resistive materials. The resistance of the material of electrode 252 can result in an increasing potential along the length of the electrode, allowing for secondary emission of electrons at multiple points along the electrode 252. Continuous dynodes use a more negative voltage in the wider entrance end 254 and goes to more positive voltage at the narrow exit end 256. Electrode 252 can be electrically coupled to contact 258 near the entrance 254 and contact 260 near the exit 256. In various embodiments, a large negative voltage can be applied to contact 258 and contact 260 can be grounded. In other embodiments, contact 258 can be grounded and contact 260 can be connected to a large positive voltage. In still other embodiments, neither contact 258 nor 260 can be connected to ground, with both contacts contacted to a voltage such that the voltage applied to contact 258 is more negative than the voltage applied to contact 260. This can include both voltages being negative, the voltage applied to contact 258 being negative and the voltage applied to contact 260 being positive, or both voltages being positive.

In various embodiments, secondary electron emission can begin when an electron 262 hits electrode 252 at a more negative region near entrance 254. Secondary electrodes are ejected that cascade onto further down the electrode 252 at a more positive region and repeats the process over again.

Electron multipliers age with time, in part due to organic contaminates being deposited on the surface of the dynodes. In contrast, photomultipliers, which are essentially electron multipliers where the initial electron is generated by a photo-emissive surface, are considerably more stable and robust. This can be attributed to the fact that photomultipliers are sealed under vacuum and not exposed to organic compounds in the vicinity of the detector. The sealing of the photomultiplier is possible because photons can penetrate an optically transparent window which keeps out background contaminates.

In various embodiments, an electron multiplier can be similarly sealed with a thin film or foil allowing high energy electrons to penetrate but blocking larger ions and organic compounds. This can protect the dynodes from organic contamination and extend the life of the electron multiplier and reduce the frequency of adjusting the calibration of the electron multiplier.

Figure 3A:
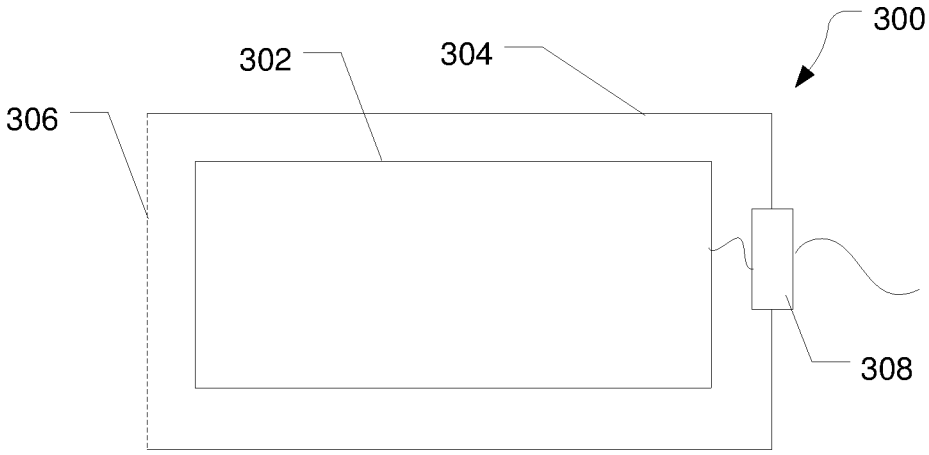
FIGS. 3A and 3B illustrate exemplary electron multipliers, in accordance with various embodiments.

FIG. 3A illustrates a sealed electron multiplier assembly 300. Sealed electron multiplier assembly 300 includes an electron multiplier 302, a housing 304, and an electron-transparent, gas impermeable barrier 306. The electron multiplier 302 can be a discrete-dynode electron multiplier or a continuous-dynode electron multiplier. Housing 304 can surround electron multiplier 302 on all sides with an opening near the entrance to the electron multiplier 302. Electron-transparent, gas impermeable barrier 306 can cover the opening in the housing. Electron-transparent, gas impermeable barrier 306 can allow high energy electrons (>10 keV) to pass while providing a barrier to large ions, organic molecules, and neutral gas molecules, thereby preventing organic material from depositing on the dynode surfaces. The combination of the housing 304 and the electron-transparent, gas impermeable barrier 306 can provide a hermetic seal to isolate the electron multiplier from organic molecules and ions in the environment surrounding the electron multiplier assembly 300. Additionally, housing 304 can include one or more vacuum feed throughs 308 to provide the electron multiplier 302 with the necessary voltages for operation and allow the signal from the electron multiplier 302 to be recorded and analyzed. In various embodiments, vacuum feed throughs 308 can be placed at the end of the electron multiplier or in various locations such that a first feed through is at the end for an anode connection and a second feed through near the entrance for the cathode high voltage connection.

In various embodiments, the electron multiplier 302 can be a continuous-dynode electron multiplier and the housing 304 can include a support structure for a continuous thin film of resistive material. The entrance end of the continuous dynode electron multiplier can be covered with the electron-transparent, gas-impermeable barrier. Similarly, the exit end of the continuous dynode electron multiplier can be sealed to provide a sealed environment for the resistive material. In various embodiments, the exit end of the continuous dynode can include a vacuum feed through for transmission of the signal.

It can be desirable to operate the electron multiplier 302 at vacuum in order to avoid issued with ion feedback. Sealed electron multiplier assembly 300 can be assembled under vacuum or evacuated prior to sealing. Additionally, a getter material can be placed inside the sealed electron multiplier assembly 300, such as on the inner surface of housing 302 to absorb any residual gas molecules left inside during assembly and to capture any molecules off gassing from materials inside the sealed electron multiplier assembly 300.

Figure 3B:
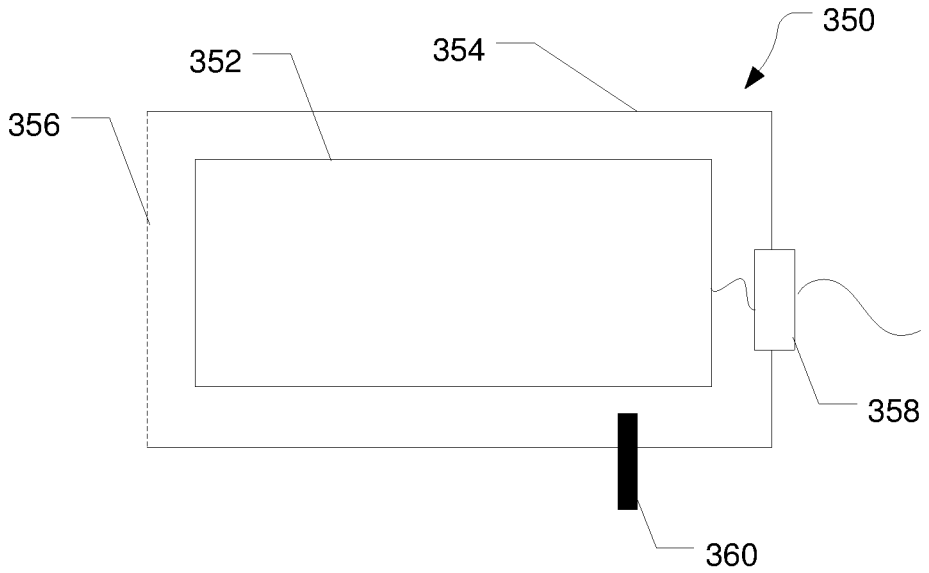

FIG. 3B illustrates a vented electron multiplier assembly 350. Vented electron multiplier assembly 350 includes an electron multiplier 352, a housing 354, and an electron-transparent barrier 356. The barrier 356 can be gas impermeable or it can be a low gas conductance barrier. The electron multiplier 352 can be a discrete-dynode electron multiplier or a continuous-dynode electron multiplier. Housing 354 can surround electron multiplier 352 on all sides with an opening near the entrance to the electron multiplier 352. Electron-transparent, gas impermeable barrier 356 can cover the opening in the housing. Electron-transparent, gas impermeable barrier 356 can allow high energy electrons (>10 keV) to pass while providing a barrier to large ions, organic molecules, and neutral gas molecules, thereby preventing organic material from depositing on the dynode surfaces. Additionally, housing 354 can include a vacuum feed through 358 to provide the electron multiplier 352 with the necessary voltages for operation and allow the signal from the electron multiplier 352 to be recorded and analyzed.

Housing 354 can further include a low gas conductance vent 360 to partially equalize the pressure between the inside and outside of the vented electron multiplier assembly 350. In various embodiments, the low gas conductance vent 360 can include a tube. The tube can be filled with an absorbent material to prevent organic contaminates from entering the housing. The absorbent material can include a molecular sieve, activated carbon, or any combination thereof. In other embodiments, barrier 356 can have a low gas conductance and function as the low gas conductance vent 360. The low gas conductance vent can allow for the equalization of pressure between the interior and exterior of the electron multiplier assembly 350. This can reduce the pressure differential that the barrier has to withstand. A combination of the size and length of the tube and the addition of the absorbent material can substantially prevent organic molecules from reaching the inside of the electron multiplier assembly 350.

In various embodiments, the electron multiplier 352 can be a continuous-dynode electron multiplier and the housing 354 can include a support structure for a continuous thin film of resistive material. The entrance end of the continuous dynode electron multiplier can be covered with the electron-transparent barrier. Similarly, the exit end of the continuous dynode electron multiplier can be restricted and incorporate the low gas conductance vent 360.

Figure 4:
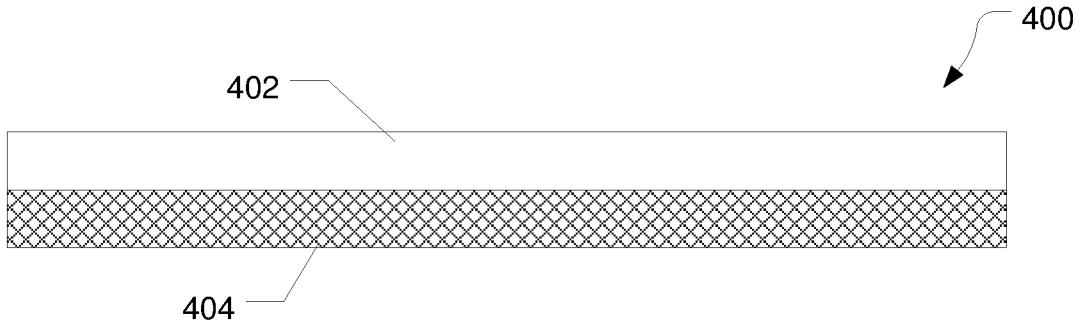
FIG. 4 illustrates an electron-transparent, gas-impermeable barrier for use at the entrance of an electron multiplier, in accordance with various embodiments.

FIG. 4 illustrates an electron-transparent barrier 400. In various embodiments, the barrier 400 can be a gas impermeable barrier or a low gas conductance barrier. Barrier 400 can include a barrier layer 402 and an optional high transmission grid 404. Barrier layer 402 can be of a material and have a thickness to allow high energy electrons, such as at energies of at least about 10 keV, to pass through while prohibiting the passage of large ions and organic molecules. As barrier 402 can be relatively thin, optional grid 404 can provide structural support to and the pressure difference between an evacuated interior of the sealed electron multiplier and atmospheric pressure outside of the sealed electron multiplier. In various embodiments, the optional high transmission grid 404 can be located on a low-pressure side of the barrier layer 402. For example, if the electron multiplier is evacuated and can experience an atmospheric environment during prior to assembly or while the mass spectrometer is offline, the high transmission grid 404 could be adjacent to the interior side of barrier layer 402.

In various embodiments, the barrier layer 402 can include a metal foil, a polymer film, or any combination thereof. The metal foil can include aluminum (Al), gold (Au), nickel (Ni), beryllium (Be), titanium (Ti), magnesium (Mg), stainless steel, or any combination thereof. The polymer film can include polyimide (such as KAPTON), polyamide, polyamide-imide, polyethylene, polyethylene terephthalate (including biaxially-oriented polyethylene terephthalate such as MYLAR), polypyrrole, cellulose (such as PARLODION or COLLODION), polyvinal acetate, polyvinal formal (such as FORMVAR or VINYLEC), polyvinal butral (such as BUTVAR or PIOLOFORM), parylene, or any combination thereof. The polymer film can be a metalized polymer film. In other embodiments, the barrier layer 402 can include a thin glass or ceramic. The thin glass or ceramic can include silicon nitride (SiN), silicon dioxide ($SiO_2$), silicon carbide (SiC), silicon monoxide (SiO), titanium nitride (TiN), beryllium nitride ($Be_3N_2$), boron carbide ($B_4C$), aluminum carbide ($Al_4C_3$), or any combination thereof.

In various embodiments, the high transmission grid 404 can be a metal grid positioned adjacent to the barrier layer 402 and provide structural support. Additionally, the high transmission grid 404 can be energized to accelerate electrons towards the first dynode.

Figure 5A:
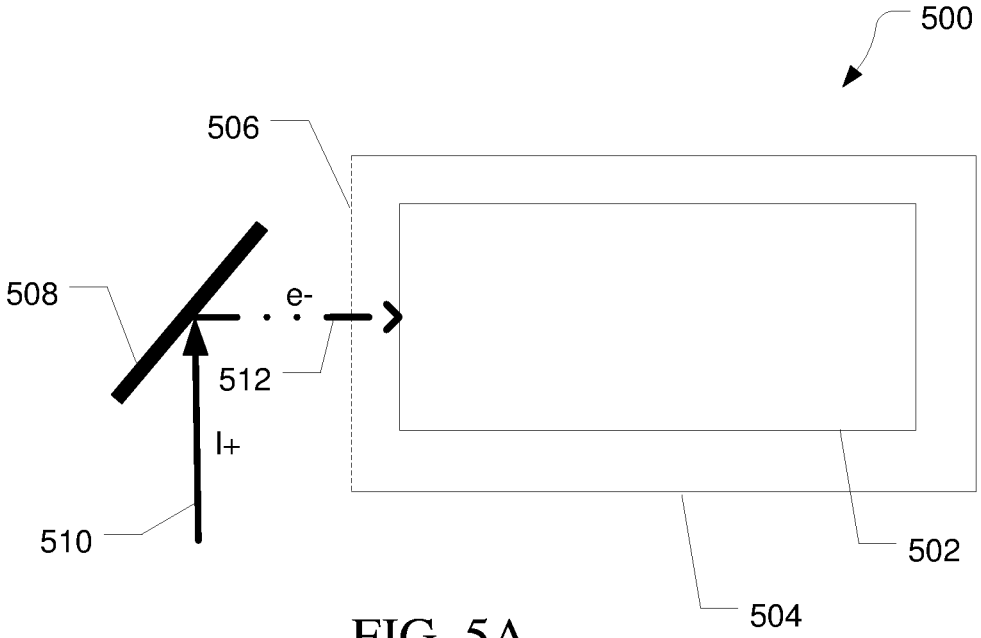
FIGS. 5A and 5B illustrate exemplary ion detectors, in accordance with various embodiments.

FIG. 5A illustrates the operation of an exemplary detector 500. Detector 500 includes an electron multiplier 502 within a housing 504 with an electron-transparent, gas-impermeable barrier 506 near the entrance of the electron multiplier 502. Detector 500 also includes a conversion dynode 508. Positive ions 510 can impact conversion dynode 508 and generate secondary electrons 512. The secondary electrons 512 can pass through the electron-transparent, gas-impermeable barrier 506 to the electron multiplier 502 where they can be amplified and a signal proportional to the number of ions 510 can be generated. The conversion dynode 508 can be negative relative to the entrance of the electron multiplier 502 so as to accelerate the secondary electrons into the electron multiplier 502.

Figure 5B:
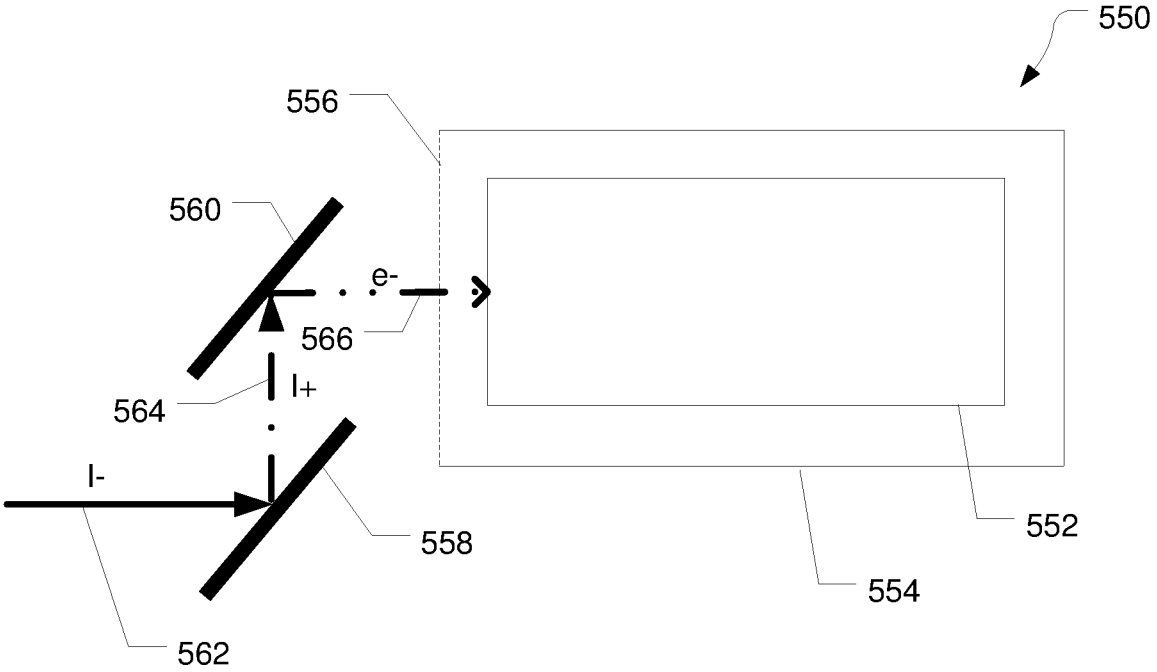

FIG. 5B illustrates the operation of an exemplary detector 550. Detector 550 includes an electron multiplier 552 within a housing 554 with an electron-transparent, gas-impermeable barrier 556 near the entrance of the electron multiplier 552. Detector 550 also includes conversion dynodes 558 and 560. Negative ions 562 can impact conversion dynode 558 and generate secondary particles including secondary positive ions and/or protons 564. The secondary positive ions and/or protons 564 can impact conversion dynode 560 and generate secondary electrons 566. Secondary electrons 566 can pass through the electron-transparent, gas-impermeable barrier 556 to the electron multiplier 552 where they can be amplified and a signal proportional to the number of negative ions 562 can be generated. Conversion dynode 558 can be positive relative to conversion dynode 560 so as to accelerate the secondary positive ions and/or protons 564 towards conversion dynode 560. Conversion dynode 560 can be negative relative to the entrance of the electron multiplier 552 so as to accelerate the secondary electrons into the electron multiplier 552.

In various embodiments, the electron-transparent, gas-impermeable barrier can be set at a potential more negative than the electron emissive surface. Doing so can aid in accelerating the electrons that pass through the barrier towards the electron emissive surface. In some embodiments, the barrier can be held at ground and the electron emissive surface can set at a positive potential sufficient to accelerate the electrons.

Figure 6:
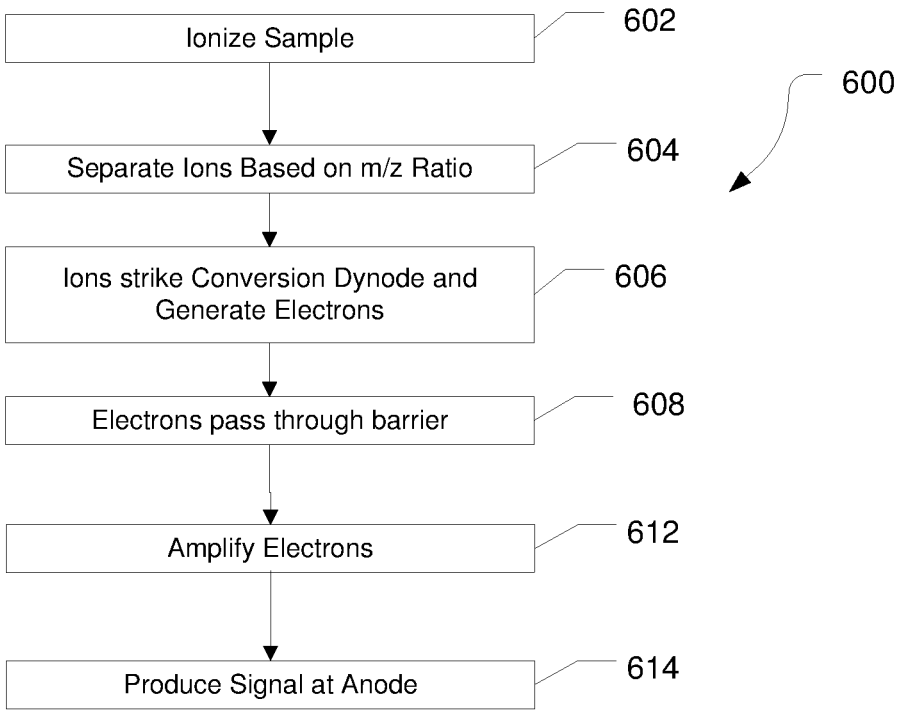
FIG. 6 illustrates an exemplary method of analyzing a sample by mass spectroscopy, in accordance with various embodiments.

FIG. 6 illustrates a method of analyzing a sample. At 602, the sample can be ionized to produce a number of ions. The ions can be separated based on mass-to-charge ratio, as indicated at 604. In various embodiments, additional techniques can also be used to separate the ions, such as ion mobility. At 606, the ions can strike a conversion dynode generating secondary electrons. The secondary electrons can pass through an electron-transparent, gas-impermeable barrier, as indicated at 608. Once across the barrier, the electrons can reach an electron multiplier which can amplify the electrons, as indicated at 612. At 614, the amplified electrons can be captured at an anode and a signal can be produced. The signal can be proportional to the number of ions that arrived at the conversion dynode. The signal can be correlated with the separation of the ions based on mass-to-charge ratio to generate a mass spectrum indicating intensity of the signal as a function of mass-to-charge ratio.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. An electron multiplier comprising:

a series of discrete electron emissive surfaces or a continuous electron emissive resistive surface configured to provide an electron amplification chain; and a housing surrounding the series of electron emissive surfaces or the continuous electron emissive resistive surface and separating the environment inside the housing from the environment outside the housing, the housing including:

an electron-transparent, gas-impermeable barrier configured to allow electrons to pass through into the housing to reach a first discrete electron emissive surface of the series of discrete electron emissive surfaces or a first portion of the continuous electron emissive resistive surface.

2. The electron multiplier of claim 1, wherein the electron-transparent, gas-impermeable barrier includes a ceramic sheet.

3. The electron multiplier of claim 2, wherein the ceramic includes silicon nitride (SiN), silicon dioxide ($SiO_2$), silicon carbide (SiC), silicon monoxide (SiO), titanium nitride (TiN), beryllium nitride ($Be_3N_2$), boron carbide ($B_4C$), aluminum carbide ($Al_4C_3$), or any combination thereof.

4. The electron multiplier of claim 1, wherein the electron-transparent, gas-impermeable barrier includes a metal foil, a polymer film, or any combination thereof.

5. The electron multiplier of claim 4, wherein the metal foil includes aluminum (Al), gold (Au), nickel (Ni), beryllium (Be), titanium (Ti), magnesium (Mg), stainless steel, or any combination thereof.

6. The electron multiplier of claim 4, wherein the polymer film includes polyimide, polyamide, polyamide-imide, polyethylene, polyethylene terephthalate, polyester, polypyrrole, cellulose, polyvinal acetate, polyvinal formal, polyvinal butral, parylene, or any combination thereof.

7. The electron multiplier of claim 4, wherein the polymer film is a metalized film.

8. The electron multiplier of claim 4, wherein the electron-transparent, gas-impermeable barrier includes a high transmission grid positioned adjacent to the metal foil or polymer film.

9. The electron multiplier of claim 1, wherein the housing is hermetically sealed to maintain a vacuum inside the housing separate from the environment outside the housing.

10. The electron multiplier of claim 9, wherein the housing further includes a getter material.

11. The electron multiplier of claim 1, wherein the housing further includes a low gas conductance vent to partially equalize the pressure between inside and outside.

12. The electron multiplier of claim 11, wherein the low gas conductance vent includes a tube.

13. The electron multiplier of claim 12, wherein the tube contains an absorbent material to prevent organic contaminates from entering the housing.

14. The electron multiplier of claim 13, wherein the absorbent material includes a molecular sieve, activated carbon, or any combination thereof.

15. The electron multiplier of claim 1, wherein the electron-transparent, gas-impermeable barrier is configured to be at a potential more negative than the first discrete electron emissive surface of the series of discrete electron emissive surfaces or an entrance end of the continuous electron emissive semiconductor surface.

16. The electron multiplier of claim 1, wherein the electron-transparent, gas-impermeable barrier is held at ground.

17. A mass spectrometer comprising:

an ion source configured to produce ions from a sample;

a mass analyzer configured to separate the ions based on mass-to-charge ratio; and a detector including:

a conversion dynode; and an electron multiplier of claim 1.

18. The mass spectrometer of claim 17, wherein the detector further includes a second conversion dynode, wherein the ions having a negative charge, the conversion dynode is configured to generate low molecular weight positive ions and/or protons when struck with the ions, and the second conversion dynode is configured to generate electrons when struck with the low molecular weight positive ions and/or protons.

19. The mass spectrometer of claim 17, wherein the ions having a positive charge and the conversion dynode is configured to generate electrons when struck with the ions.

20. A method of analyzing a sample, the method comprising:

ionizing the sample with an ion source to produce ions;

separating the ions based on mass-to-charge ratio in a mass analyzer;

directing the ions to a conversion dynode to produce electrons;

passing the electrons through an electron-transparent, gas-impermeable barrier of a housing of an electron multiplier to strike a first discrete electron emissive surface of a series of discrete electron emissive surfaces or a continuous electron emissive semiconductor surface;

amplifying the electrons with the series of discrete electron emissive surfaces or the continuous electron emissive semiconductor surface; and producing a signal at an anode proportional to the amplified electrons reaching the anode, the signal being proportional to an amount of a compound in the sample.

* * * * *